United States Patent [19]

Morrison

[11] Patent Number: 4,611,146

[45] Date of Patent: Sep. 9, 1986

[54] INDIRECTLY HEATED CATHODE

[75] Inventor: Raymond C. Morrison, Scituate, Mass.

[73] Assignee: Raytheon Company, Lexington, Mass.

[21] Appl. No.: 336,233

[22] Filed: Dec. 31, 1981

[51] Int. Cl.[4] ..... H01J 29/48; H01J 1/20; H01J 1/16

[52] U.S. Cl. ..... 313/446; 313/337; 313/344; 445/50

[58] Field of Search ..... 313/446, 448, 337, 344, 313/342, 341, 340; 445/50; 140/71.5

[56] References Cited

U.S. PATENT DOCUMENTS

| | | | |
|---|---|---|---|
| 1,157,995 | 10/1915 | Mackay | 313/578 |
| 1,828,203 | 10/1931 | Ruben | 313/308 |
| 2,141,933 | 12/1938 | Perrott | 313/629 |
| 2,142,865 | 1/1939 | Zabel | 148/11.5 F |
| 2,260,308 | 10/1941 | Fidler | 313/310 |
| 2,297,454 | 9/1942 | Berger | 313/343 |
| 2,549,355 | 4/1951 | Winninghoff | 313/492 |
| 2,619,706 | 12/1952 | Vause | 445/51 |
| 2,869,032 | 1/1959 | Turner | 315/39.51 |
| 4,149,104 | 4/1979 | Yoshimori | 140/71.5 |
| 4,185,223 | 1/1980 | Anezaki | 313/446 |

FOREIGN PATENT DOCUMENTS

| | | | |
|---|---|---|---|
| 218309 | 8/1968 | U.S.S.R. | 313/344 |

*Primary Examiner*—Palmer C. DeMeo
*Assistant Examiner*—Sandra L. O'Shea
*Attorney, Agent, or Firm*—John T. Meaney; R. M. Sharkansky

[57] ABSTRACT

An indirectly heated cathode including a conductive cup having a closed end provided with an exterior surface coating of electron emissive material and an electrically insulated heater element disposed axially within the cup. The heater element comprises a coaxial pair of outer and inner filamentary coils wound helically in electrical series from a single strand of electrical wire and having integral interconnecting portions adjacent the closed end of the cup for resiliently supporting the inner coil within the outer coil and in alignment with the central portion of the electron emissive coating. The turns of the outer coil are coated with a heat transmissive dielectric material and slidably engage the inner axially extending surface of the cup for positioning the inner coil in alignment with the central portion of the electron emissive coating, maximizing transfer of heat by radiation from the outer coil to the engaged wall of the cup, and providing a thermal barrier to enhance the transfer of heat by radiation from the inner coil to the central portion of the electron emissive coating.

16 Claims, 8 Drawing Figures

FIG. 1
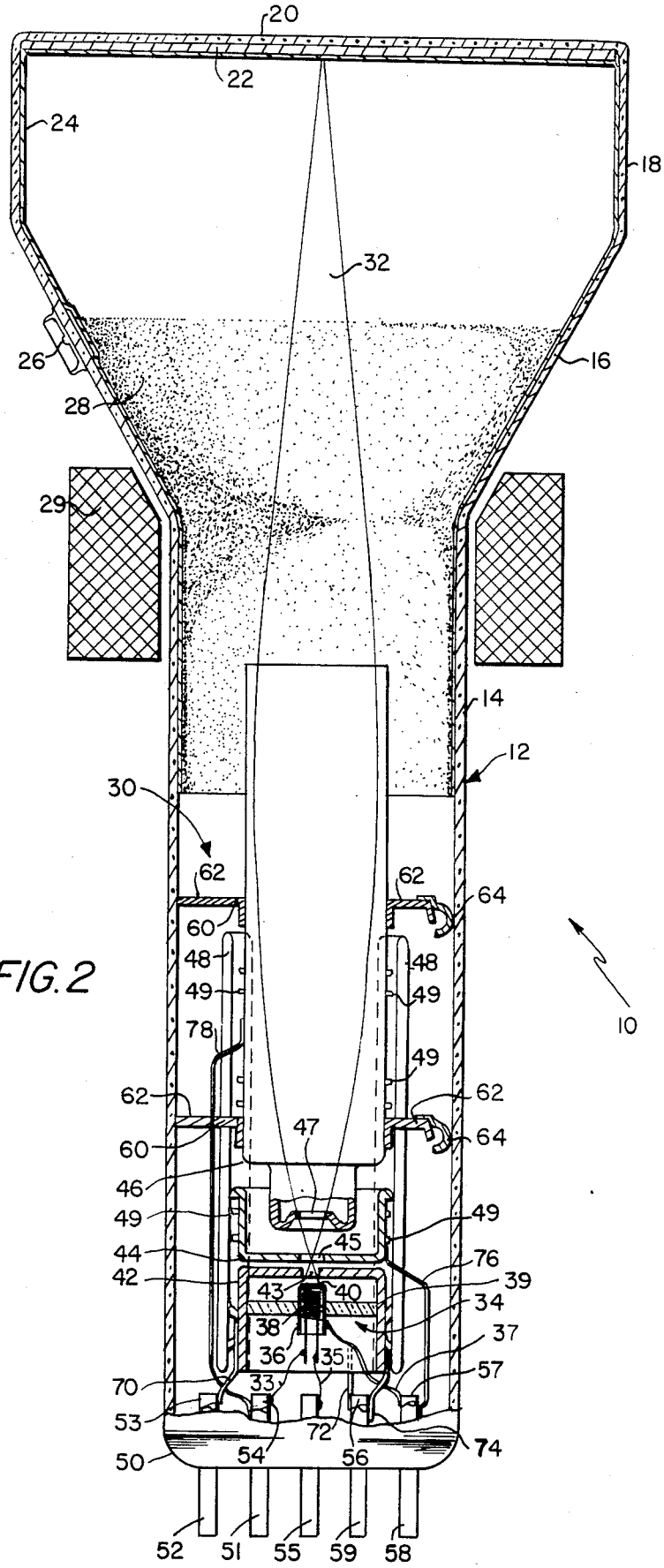
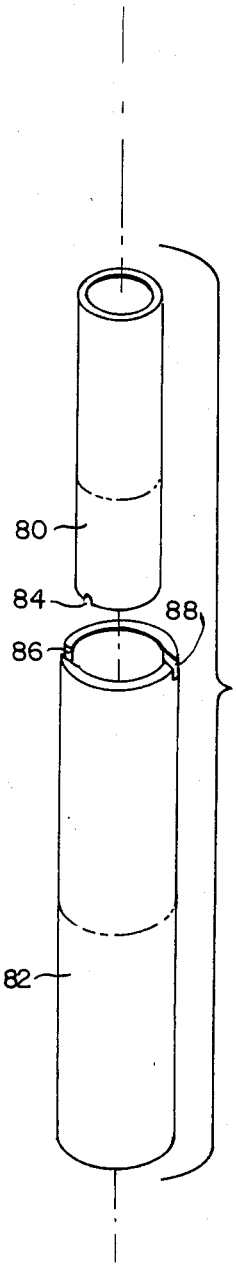
FIG. 2

INDIRECTLY HEATED CATHODE

BACKGROUND OF THE INVENTION

1. Field of the Invention

This invention relates generally to indirectly heated cathodes for electron tubes and is concerned more particularly with an indirectly heated cathode for an electron gun in a cathode ray type tube.

2. Discussion of the Prior Art

An electron tube of the cathode ray type may comprise a generally funnel-shaped envelope having a neck-end portion wherein an electron gun is axially disposed for directing an electron beam onto an anode imaging screen adjacent the large diameter end of the envelope. The electron gun includes a thermionic cathode which generally is of the indirectly heated type comprising an inverted cathode cup having a closed end outer surface provided with an electron emissive coating. Axially disposed within the cathode cup is an electrically insulated heater coil of filamentary wire which is heated by an electrical current flowing through the coil. Thus, a predetermined value of current may be passed through the coil to heat it to a suitable temperature for radiating sufficient thermal energy to the adjacent walls of the cathode cup to heat the electron emissive coating to a desired electron emitting temperature.

The cathode cup may be insulatingly supported within an inverted first grid cup having a closed end provided with a central aperture which is disposed in close-spaced alignment with the electron emissive coating. Therefore, electrons emitted from the electron emissive coating are directed toward the aperture in the first grid and are permitted to pass through it in accordance with the electrical bias potential of the first grid with respect to the potential of the cathode cup. Accordingly, the first grid generally is biased at a steady-state value of potential suitable for permitting passage of a predetermined value of electron current through the aperture in the first grid cup. Also, the first grid may have applied to it a variable signal voltage which alters its bias potential for producing corresponding increases and decreases in the predetermined value of electron current passing through the aperture in the first grid cup.

The electron gun also may include an axial series of spaced beam-forming electrodes which are aligned with the first grid for forming electrons passing through the aperture in the first grid into a beam and focussing the beamed electrons to impinge on a circular spot area of the anode imaging screen. Also, the electron beam may be deflected by conventional means to scan over successive circular spot areas of the imaging screen in well-known fashion. Thus, by varying the electron current in the beam as it scans over the successive circular spot areas, there may be produced on the anode imaging screen a visible light image which is viewable through the large diameter end of the tube envelope.

In order to enhance resolution in the visible light image, it is necessary that the beam-forming electrodes of the gun focus the beamed electrons onto a minimized spot area of the anode imaging screen. Consequently, it is desirable that the electron emissive coating on the closed end of the cathode cup be heated to a temperature sufficient for producing a space-charge limited emission of electrons from the coating. Preferably, the space-charge limited emission is distributed over the exposed surface of the electron emissive coating in a substantially bell-shaped configuration with the heaviest emission being from the central portion of the coating. Thus, there will be provided between the respective closed ends of the cathode and the first grid a reserve of electrons adequate for supplying not only the predetermined value of electron current but also increases required in the predetermined value. These increases may be occasioned by corresponding variations in the signal voltage applied to the first grid and adjustments in the steady-state value of the first grid bias potential to cause an increase in brightness in the visible light image produced on the anode imaging screen.

In operation, it may be found that the central portion of the electron emissive coating on the closed end of the cathode cup operates at a significantly lower temperature as compared to outer marginal portions of the coating. This difference in operating temperatures may be due to heat being lost from the central portion by radiation through the aligned aperture in the first grid, whereas heat radiated from outer marginal portions of the coating may be reflected back thereto by aligned portions of the first grid encircling its aperture. As a result, the central portion of the electron emissive coating may provide only a temperature-limited emission of electrons which is inadequate for establishing the desired reserve of electrons between respective closed ends of the cathode and the first grid.

Consequently, when the steady-state value of potential on the first grid is decreased negatively with respect to the potential of the cathode, the additional electrons required for supplying a corresponding increase in electron current are drawn from outer marginal portions of the electron emissive coating. The resulting electron beam impinging on the anode imaging screen produces a halo-like spot of relatively larger size which degrades resolution in the visible light image produced on the imaging screen. Also, when the temperature of the heater coil within the cathode cup is increased to raise the temperature of the central portion of the electron emissive coating, it may be found that component materials of the cathode sublimate and cause electrical leakage which deteriorates tube performance.

SUMMARY OF THE INVENTION

Accordingly, these and other disadvantages of the prior art devices are overcome by this invention which includes an indirectly heated cathode comprising an inverted cathode cup having a closed end outer surface provided with an electron emissive coating, and having within the cup an electrically insulated heater element provided with means for heating a central portion of the coating to a higher temperature than outer marginal portions of the coating. The heater element comprises a coaxial pair of outer and inner coils wound helically in electrical series from a single strand of filamentary wire and having at the ends of the coils adjacent the closed end of the cathode cup integral interconnecting portions which resiliently support the inner coil within the outer coil. The turns of the outer coil are coated with a heat transmissive dielectric material and slidably engage the axial inner wall surface of the cathode cup for resiliently positioning the inner coil in alignment with the central portion of the electron emissive coating on the outer surface of the closed end of the cup, for maximizing transfer of heat by radiation from the outer coil to the axial wall of the cup, and for providing a thermal barrier to concentrate the flow of radiational heat from the inner coil in the direction of the central portion of the electron emissive coating.

BRIEF DESCRIPTION OF THE DRAWINGS

For a more complete understanding of this invention, reference is made in the following detailed description to the accompanying drawings wherein:

FIG. 1 is an axial view, partly in section, of a cathode ray type of electron tube embodying the invention;

FIG. 2 is an isometric view of respective inner and outer mandrels used in fabricating the heater element of the indirectly heated cathode shown in FIG. 1;

DESCRIPTION OF THE PREFERRED EMBODIMENTS

Figure 4:
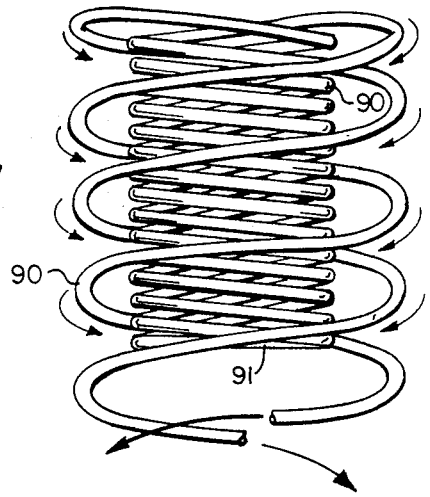
FIG. 4 is an elevational view of the heater coils shown in FIG. 3 to illustrate the direction and the bifilarly method of winding the coils.

Referring to the drawings wherein like characters of reference designate like parts, there is shown in FIG. 1 an electron tube 10 of the cathode ray type having an evacuated envelope 12 which is generally funnel-shaped and made of dielectric material, such as glass, for example. Envelope 12 includes a neck-end portion 14 which is integrally joined through an intermediate flared portion 16 to an opposing end portion 18 of larger diameter. The larger diameter end portion 18 terminates at one end of tube 10 in a transversely disposed ouput faceplate 20 made of suitable transparent material, such as the glass material of envelope 12, for example. Faceplate 20 has disposed on its inner surface an anode target comprising an imaging screen layer 22 made of fluorescent material, such as zinc sulfide, for example. The layer 22 fluoresces locally when a discrete region thereof is penetrated by electrons in a beam 32 emanating from an electron gun 30 which is axially disposed within neck-end portion 14 of envelope 12.

Deposited by well-known means on the inner surface of layer 12 is a light reflective coating 24 of electrically conductive material, such as aluminum, for example, which is sufficiently thin to be substantially transparent to the beamed electrons. The coating 24 extends annularly onto an axially disposed inner surface of end portion 18 and onto the sloped inner surface of intermediate flared portion 16. Extending hermetically through the wall of intermediate flared portion 16 is an anode terminal button 26 whereby an anode potential is applied to the anode electrode of tube 10. Terminal button 26 is electrically connected to the coating 24 and to a coating 28 of another electrically conductive material, such as carbon, for example. The coating 28 extends annularly along the sloped inner surface of intermediate flared portion 16 and into neck-end portion 14 a suitable distance for insulatingly encircling an exit end portion of the electron gun 30. As a result, electrons in a beam 32 emanating from the exit end of gun 30 enter a substantially field-free space within the cup-shaped anode electrode formed by the respective coatings 24 and 28 electrically connected to the terminal button 26. Accordingly, the beamed electrons are accelerated and focussed onto an aligned discrete area of imaging screen layer 22 where they penetrate into the underlying material and cause it to fluoresce locally.

The electron beam 32 emanating from gun 30 and terminating on imaging screen layer 22 may be deflected angularly with respect to the axial centerline of tube 10 by appropriate means, such as a conventional deflection yoke 29 disposed externally about a portion of envelope 12 adjacent the exit end of gun 30, for example. Thus, the electron beam 32 may be scanned over successive discrete regions of the imaging screen layer causing them to fluoresce locally and produce a visible light image which is viewable through the output faceplate 20 in a well-known manner.

The neck-end portion 14 of envelope 12 terminates at the other end of tube 10 in a peripherally sealed glass disc or stem press 50 which has extending axially through it a sealed circular array of mutually spaced terminal pins, 51–59, respectively. Axially spaced from the inner end portions of pins 51–59 is an electron generating end portion of gun 30 comprising an indirectly heated cathode 34 which includes an inverted cathode cup 36 having axially disposed therein an electrically insulated heater 38. The heater 38 has a pair of terminal end portions electrically connected to respective terminal pins 54 and 55 through electrical conductors, 33 and 35, respectively, which have sufficient rigidity to support the heater 38 within the cathode cup 36. Cathode cup 36 is made of conductive material, such as nickel, for example, and is electrically connected to terminal pin 57 through an electrical conductor 37. The cathode cup 36 is supported axially in spaced insulating relationship within an inverted first grid cup 42 by an interposed annulus 39 of dielectric material, such as ceramic, for example. Thus, cathode cup 36 has a closed end disposed in juxtaposed close-spaced relationship with the closed end of first grid cup 42.

The closed end of cathode 36 is provided with an exterior coating 40 of electron emissive material, such as oxides of barium and strontum, for example. This electron emissive coating 40 is disposed for directing emitted electrons through an aperture 43 centrally disposed in the closed end of first grid cup 42 and aligned with the central portion of coating 40. The closed end of inverted first grid cup 42 is disposed in close spaced, juxtaposed relationship with a closed end of an upright second grid cup 44. Centrally disposed in the closed end of second grid cup 44 is an aperture 45 which is slightly larger in diameter than the aperture 43 and is axially aligned with it. The opposing open end portion of second grid cup 44 has insulatingly extended within it a reduced diameter, closed end portion of an elongated, third cup-like focussing electrode 46. The closed end of this third cup-like electrode 46 is provided with a central aperture 47 which is slightly larger in diameter than the aperture 45 and is axially aligned with it as well as with the aperture 43. All of the apertures 43, 45 and 47 have respective circular configurations and are axially aligned with one another for permitting passage of properly directed electrons which are formed into the beam 32 by the electrodes 42, 44 and 46, respectively.

Accordingly, the respective elements 42, 44, and 46 of gun 30 constitute an axially extending series of beam-forming electrodes which may be insulatingly attached to one another in a sub-assembly structure. Consequently, the series of beam-forming electrodes 42, 44 and 46 may be disposed within an axially extending array of angularly spaced posts 48 made of rigid dielectric material, such as borosilicate glass, for example. Each of the posts 48 may have embedded therein leg end portions of respective C-shaped brackets 49 having projecting bight portions attached, as by welding, for example, to adjacent wall portions of a respective coplanar one of the beam-forming electrodes in the axially extending series. The brackets 49 are made of rigid material, such as nonmagnetic stainless steel, for example, and support the attached beam-forming electrodes 42, 44 and 46 of the resulting sub-assembly in fixed positional relationship with one another as well as maintaining the respective apertures 43, 45 and 47 in axial alignment with one another.

The beam-forming sub-assembly may be transversely supported within the neck-end portion 14 by conventional means, such as a plurality of axially spaced rings 60 encircling the focussing electrode 46, for example. The rings 60 are made of suitable rigid material, such as non-magnetic stainless steel, for example and have respective inner peripheral collar portions attached, as by welding or brazing, for examples, to the outer cylindrical surface of electrode 46. Each of the rings 60 is provided with a plurality of radially extending projections 62 which are angularly spaced apart about the axial centerline of attached electrode 46. In the radial direction, each of the respective projections 62 extends between two of the dielectric posts 48 and has a generally triangular configuration terminating in a rounded apex or tip which contacts the inner surface of neck-end portion 14. At least one of the projections 62 extending radially from each of the rings 60 has a resilient tip 64 comprised of a welded strip of stainless steel having a resiliently yielding curvature in the axial direction for pressingly engaging the inner surface of neck-end portion 14. The other projections 62 of the rings 60 have respective rigid tips which are pressed into firm radial contact with the inner surface of neck-end portion 14 as a result of the pressure exerted by resilient tip 64 against the inner surface of portion 14.

The neck-end portion 14 of the glass envelope 12 has a radius which is substantially equal to the radial extent of the projections 62 as measured, from the axial centerline of attached electrode 46. Accordingly, the projections 62 having their respective rigid tips pressed into firm radial contact with the inner surface of neck-end portion 14 position the axial centerline of electrode 46 substantially on the axial centerline of neck-end portion 14. As a result, an electron beam emanating from the open end of electrode 46 comprising the exit end portion of gun 30 travels substantially along the axial centerline of neck-end portion 14 and the anode coating 28. In this manner, an electron beam generated in gun 24 is maintained substantially symmetrical with respect to the axial centerline of the electrostatic lense system of tube 10.

The sub-assembly of beam-forming electrodes 42, 44 and 46 may be axially supported within neck-end portion 44 by three rigid strap-like conductors 70, 72 and 74, respectively, which electrically connect the first grid electrode 42 to angularly spaced terminal pins 53, 56 and 59, respectively. The second grid electrode 44 and the focussing electrode 46 are electrically connected through respective conductors 76 and 78 to terminal pins 58 and 51, respectively. Thus, the beam-forming electrodes 42, 44 and 46 are provided with external connecting means for having respective electrical voltages applied to them. Thus, the beam-forming electrodes 42, 44 and 46 may be maintained at respective electrical potentials relative to the potential of the cathode 34 for establishing therebetween desired electrostatic fields. These electrostatic fields not only direct the electrons passed through first grid aperture 43 into the beam 32 but also aid in focussing the beamed electrons onto a small circular spot area of imaging screen layer 22 to enhance resolution in the resulting image formed thereon.

However, in order to achieve this objective, it is necessary that the electron emissive coating 40 produce a space-charge limited emission having a bell-shaped or Gaussian distribution over the exposed surface of the coating 40. Furthermore, this type of distribution requires that the greatest emission of electrons be from the central portion of the coating 40 opposite the first grid aperture 43.

Therefore, the cathode 34 of gun 30 is provided with a heater 38 which may be wound in accordance with this invention by using, as shown in FIG. 2 a telescopic pair of inner and outer mandrels, 80 and 82, respectively. Each of the mandrels 80 and 82 may comprise a respective tubular member made of rigid material, such as molybdenum, for example. The inner mandrel 80 includes an end portion having a notch 84 diametrically disposed in its end surface. The notched end portion of inner mandrel 80 is insertable into an end portion of outer mandrel 82 which has a pair of respective notches 86 and 88 extending through opposing radial portions of its end surface and generally tangentially relative to the telescoped inner mandrel 80.

Prior to inserting the notched end portion of inner mandrel 80 into the notched end portion of outer mandrel 82, the opposing end portion of inner mandrel 86 is clamped in a conventional coil winding lathe chuck (not shown). A single strand of electrical wire 90, which is made of suitable filamentary material, such as tungsten, for example, has a midportion 91 (FIG. 5) laid in the diametric notch 84 of inner mandrel 80 such that respective free end portions of the wire 90 extend out of opposing ends of the notch 84. One of the free end portions is wound one-half a turn around the mandrel 80 to lay in spaced colinear relationship with the other free end portion of wire 90. Then, the inner mandrel 80 is rotated about its axial centerline and advanced in the direction of a right-hand screw to cause the free end portions of wire 90 to wind bifilarly as respective adjacent turns and at a uniform pitch along the, inner mandrel 80 thereby forming an inner coil 92 of heater 38. After winding a predetermined length such as about one-third, for example, of wire 90 into inner coil 92, the rotation of inner mandrel 80 may be stopped and the inner mandrel 80 removed from the lathe chuck.

Figure 3:
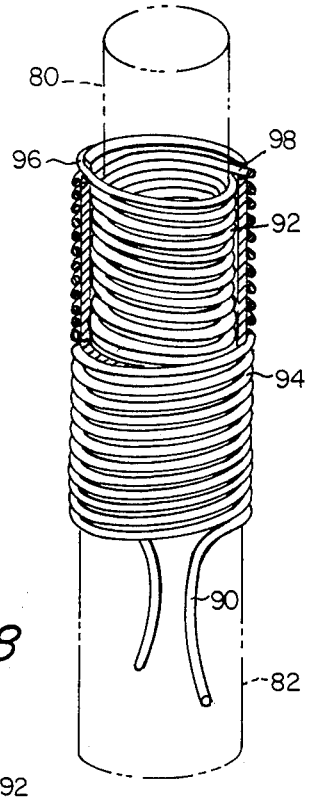
FIG. 3 is an axial view, partly in section, illustrating the inner and outer heater coils of the indirectly heated cathode shown in FIG. 1 as wound on the mandrels shown in FIG. 2.

The wound end portion of inner mandrel 80 then is slidably inserted into the notched end portion of outer mandrel 82, as shown in FIG. 3, until the unwound or free end portions of wire 90 have respective integral portions 96 and 98 thereof laying in the notches 86 and 88 which extend tangentially not only to the inner mandrel 82 but also to the inner coil 90 wound thereon. The opposing end portion of outer mandrel 82 is then clamped in the lathe chuck for rotating and advancing the outer mandrel 82 in the direction of a right-hand screw. As a result, the free end portions of wire 90 extending from outer ends of the notches 86 and 88 wind bifilarly as respective adjacent turns and at a uniform pitch back along the outer mandrel 82, as shown in FIG. 4, to form an outer coil 94 in encircling relationship with the inner coil 92. When the outer coil 94 has a predetermined axial length, such as about twice as long in axial length as the inner coil, for example, rotation of outer mandrel 82 is stopped. The free end portions of wire 90 then may be cut to provide the terminal end portions described as being connected to the terminal pins 54 and 55, respectively.

Figure 5:
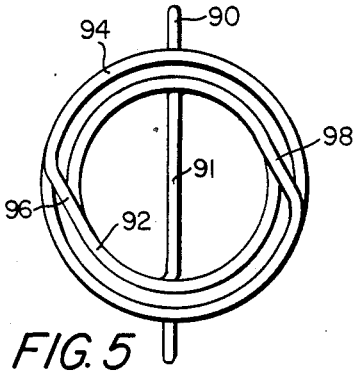
FIG. 5 is a top plan view of the wound heater coils shown in FIG. 3.
Figure 6:
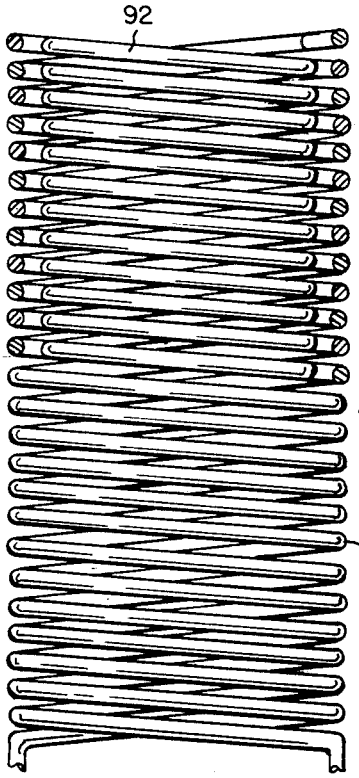
FIG. 6 is an enlarged axial view, partly in section, of the wound inner and outer heater coils shown in FIG. 3 but with the mandrels removed.

The respective inner and outer mandrels 80 and 82 may be removed by sliding them axially out of the turns of the inner and outer coils 92 and 94, respectively. Alternatively, the respective inner and outer mandrels 80 and 82 may be removed by immersing the wound assembly into a suitable acid bath, such as a bath of sulphuric acid, for example, which attacks the molybdenum material of the mandrels 80 and 82 but does not adversely affect the tungsten material of wire 90. After removal of the mandrels 80 and 82, as shown in FIGS. 5 and 6, the resulting heater 38 comprises a coaxial pair of inner and outer helical coils, 92 and 94, respectively which are wound bifilarly from the single strand of electrical wire 90. The respective inner and outer coils 92 and 94 are connected in electrical series. The inner coil 92 is resiliently supported within the outer coil 94 by the integral interconnecting portions 96 and 98 of wire 90 formerly disposed in the respective notches 86 and 88 which extend generally tangentially relative to the inner coil 92.

Figure 8:
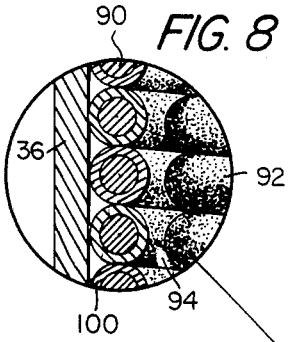
FIG. 8 is an enlarged fragmentary view of an axial portion of the inner and outer heater coils shown installed in the inverted cathode cup in FIG. 5.
Figure 7:
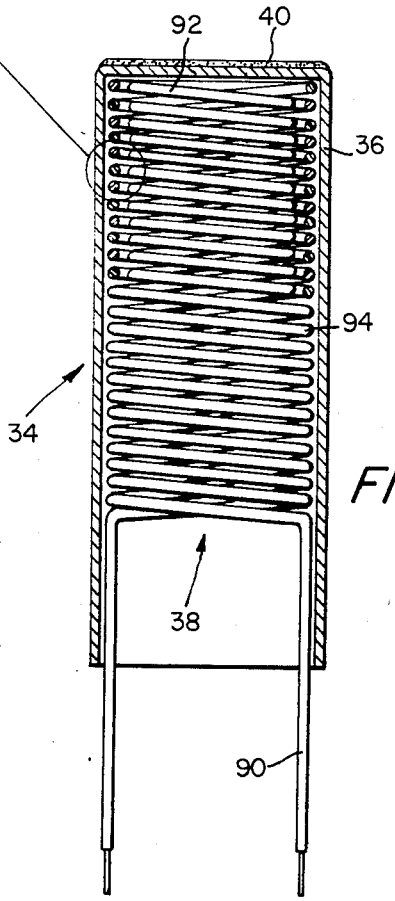
FIG. 7 is an axial view, partly in section, of the wound inner and outer heater coils shown in FIG. 4 as installed in the inverted cathode cup of the indirectly heated cathode shown in FIG. 1.

As shown in FIGS. 7 and 8, the respective inner and outer coils 92 and 94 of heater 38 then may be provided with a coating 100 of thermally transmissive dielectric material, such as ceramic, for example. This may be achieved by conventional means, such as by dipping the heater 38 in a slurry of ceramic material or by electrophoretic coating the ceramic material, for examples, and then firing at a suitable temperature for obtaining the desired ceramic properties. The resulting coated outer coil 94 has an outer diameter dimensioned for slidably engaging the inner axial surface of cathode cup 36 when the heater 38 is inserted into the open end portion of the cup. Heater 38 is urged axially within the cup 36 until the integral portions 96 and 98 of wire 90 joining adjacent ends of the respective inner and outer coils 92 and 94 abut the inner surface at the closed end of cup 36 which has on its exterior surface the electron emissive coating 40. Thus, the outer coil 94 slidably engaging the inner axial surface of cup 36 resiliently positions the inner coil 92 in axial alignment with the central portion of coating 40.

As a result, when the terminal end portions of heater 38 are electrically connected to the respective terminal pins 54 and 55, as described, the same heating current that flows through outer coil 94 also flows through the inner coil 92. Since the outer coil 94 slidably engages the inner axial surface of cathode cup 36 and is aligned with outer marginal portions of coating 40, it is disposed for maximizing heat transfer from the outer coil 94 to the axial wall of cathode cup 36 and the aligned outer portion of coating 40. Also, the outer coil 94 encircles the inner coil 92 and extends axially beyond it toward the open end of cathode cup 36 to radiate heat inwardly of the cup 36 and provide a thermal barrier which restricts losses of heat from the inner coil 92. Consequently, heat is radiated from the inner coil 92 predominantly to the central portion of the closed end of cup 36 and the overlying central portion of coating 40. Thus, the heater 38 is provided with inner coil means for heating the central portion of electron emissive coating 40 to a higher electron emitting temperature than the outer marginal portions of the coating 40. Accordingly, the central portion of coating 40 may be heated to produce the relatively greater electron emission required for obtaining a bell-shaped or Gaussian distribution of space-charge limited emission from the exposed surface of the coating 40.

Thus, there has been disclosed herein an indirectly heated cathode comprising a cathode cup having a closed end provided with an exterior surface coating of electron emissive material, and an electrically insulated heater disposed axially in the cup. The heater comprises a coaxial pair of outer and inner coils wound in electrical series from a single strand of filamentary wire having integral interconnecting portions resiliently supporting the inner coil within the outer coil. The coaxial pair of inner and outer coils is axially disposed within the cathode cup such that the integral interconnecting portions of the wire are adjacent the closed end of the cup and position the inner coil for transferring heat to the central portion of the electron emissive coating on the exterior surface of the closed end of the cathode.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a limiting sense.

What is claimed is:

1. An electrode comprising a uniform diameter wire having first and second coils formed in respective integral portions of the wire, the first coil being moveably disposed within the second coil and terminating at one end in an adjacent end portion of the second coil.

2. An electrode comprising a uniform diameter wire having first and second coils formed in respective integral portions of the wire, the first coil being resiliently suspended within the second coil and having one end portion terminating in an adjacent end of the second coil.

3. An electrode comprising a uniform diameter wire having first and second coils formed in respective integral portions of the wire, the first coil being freely supported within the second coil and having an end disposed adjacent an end of the second coil, said wire including integral means disposed between said adjacent ends of the coils for suspending said first coil from said adjacent end of the second coil.

4. A cathode comprising:

a first coil of wire having a diametric size;

a second coil of wire having said diametric size and disposed within said first coil of wire; and wire means having said diametric size and integrally connecting said second coil to said first coil for supporting said second coil within said first coil.

5. A cathode as set forth in claim 4 wherein said first and second coils are helical, said second coil is axially disposed within said first coil, and said wire means is extended from an end of said second coil to an adjacent end of said first coil for connecting said first and second coils in electrical series with one another.

6. A cathode as set forth in claim 5 wherein said first and second coils are bifilarly wound and said wire means includes a plurality of wire portions extended from said end of said second coil to said adjacent end of the first coil.

7. A cathode comprising:

an electron emitter disposed for emitting electrons in accordance with its temperature;

a first coil of wire having a diametric size and disposed in predetermined positional relationship with respect to said electron emitter;

a second coil of wire having said diametric size and disposed within said first coil and having a portion disposed adjacent said electron emitter; and wire means having said diametric size and integrally connecting said first coil to said second coil for supporting said portion of said second coil in heat transfer relationship with said electron emitter.

8. A cathode as set forth in claim 7 wherein said electron emitter comprises a hollow conductive member having an electron emissive portion, and said first coil is insulatingly disposed within said hollow conductive member.

9. A cathode as set forth in claim 8 wherein said hollow conductive member comprises a cup-like conductor having a closed end provided with an exterior coating of electron emissive material and having a side wall portion provided with an inner surface.

10. A cathode as set forth in claim 9 wherein said first coil is disposed in dielectric slidable engagement with said inner surface of said side wall portion the cup-like conductor, and said wire means being disposed adjacent said closed end of the cup-like conductor for supporting said portion of the second coil in axial alignment with a central portion of the electron emitter.

11. An electron gun comprising:

beam-forming electrode means disposed for directing electrons into a beam; and cathode means disposed for directing an emission of electrons toward the beam-forming electrode means, the cathode means having electron emitter means for producing a predetermined emission of electrons and heater means disposed adjacent the electron emitter means for heating a preselected portion of the electron emitter means to a higher operating temperature than other portions of the electron emitter means;

the heater means including a first wire coil having a first portion disposed adjacent said preselected portion of the electron emitter means and having a second portion and second wire coil means integrally connected to said first wire coil and disposed for forming a thermal barrier about said second portion of the first wire coil, said first wire coil and said second wire coil means being made of uniform diameter wire.

12. An electron gun as set forth in claim 11 wherein the electron emitter means comprises a conductive cup having a closed end provided with an electron emissive coating, and said heater means is insulatingly disposed within the cup for heating a central portion of the coating to a higher operating temperature than outer marginal portions of the coating.

13. An electron gun as set forth in claim 12 wherein said first wire coil is axially aligned with said central portion of the coating, and said second wire coil means comprises a second wire coil disposed annularly between said first wire coil and the axial wall of said cup.

14. An electron gun as set forth in claim 13 wherein said second wire coil is disposed in contacting relationship with said axial wall of the cup and has portion means integrally connected to an adjacent end of said first wire coil for supporting said first coil resiliently in axial alignment with said central portion of the coating.

15. An electron gun as set forth in claim 13 wherein said first wire coil has an end integrally connected in electrical series with an adjacent end of said second coil.

16. A method for winding a coaxial pair of inner and outer filamentary coils comprising the steps of:

holding a midportion of a filamentary wire having a uniform diameter to form two free end portions thereof;

winding the two free end portions bifilarly at a uniform pitch to form the inner coil; and holding the two free end portions at the termination of the inner coil to wind the two free end portions bifilarly at a uniform pitch back along the inner coil to form the outer coil.

* * * * *